US011638467B2

(12) United States Patent
Celant et al.

(10) Patent No.: US 11,638,467 B2
(45) Date of Patent: May 2, 2023

(54) TIMEPIECE COMPONENT PROVIDED WITH A CAP

(71) Applicant: ROLEX SA, Geneva (CH)

(72) Inventors: Benjamin Celant, Geneva (CH); Benoit Junod, Peillonnex (FR); Jean-Baptiste Robin, Annemasse (FR)

(73) Assignee: ROLEX SA, Geneva (CH)

( * ) Notice: Subject to any disclaimer, the term of this patent is extended or adjusted under 35 U.S.C. 154(b) by 0 days.

(21) Appl. No.: 17/401,540

(22) Filed: Aug. 13, 2021

(65) Prior Publication Data

US 2022/0053891 A1 Feb. 24, 2022

(30) Foreign Application Priority Data

Aug. 18, 2020 (EP) ..... 20191466

(51) Int. Cl.
*A44C 5/04* (2006.01)

(52) U.S. Cl.
CPC ..... *A44C 5/04* (2013.01)

(58) Field of Classification Search
CPC ..... A44C 5/04; A44C 5/24; Y10T 24/2155; Y10T 24/4782
See application file for complete search history.

(56) References Cited

U.S. PATENT DOCUMENTS 2,446,068 A * 7/1948 Valcourt ..... A44C 5/24 24/71 J
3,445,900 A * 5/1969 Currat ..... A44C 5/24 24/71 J
3,609,962 A 10/1971 Rieth
4,543,692 A 10/1985 Ode et al.
(Continued)

FOREIGN PATENT DOCUMENTS

GB 2132680 A 7/1984
JP 2002191415 A 7/2002

OTHER PUBLICATIONS

European Search Report and Written Opinion dated Jan. 20, 2021 in priority application No. EP20191465.2 of co-pending U.S. Appl. No. 17/401,525; with English machine translation (total 14 pages).
(Continued)

*Primary Examiner* — Robert Sandy
*Assistant Examiner* — Rowland Do
(74) *Attorney, Agent, or Firm* — Seckel IP, PLLC

(57) ABSTRACT

A timepiece component, having a first part and a removable cap, which is able to adopt a fastening configuration in which the removable cap is fastened to the first part, and a free configuration in which the cap is separated from the first part. The first part comprises at least two latching members intended to cooperate with at least two corresponding assembly members of the cap in the fastening configuration. The cap or the first part is elastically deformable from a rest position to a deformed position which allows for positioning and removing for passing from the fastening configuration to the free configuration of the timepiece component and vice versa. The rest position allows stably maintain the fastening configuration of the timepiece component in which the at least two assembly members of the cap are in engagement with the at least two latching members of the first part.

20 Claims, 4 Drawing Sheets

(56) References Cited

U.S. PATENT DOCUMENTS

| | | | | |
|---|---|---|---|---|
| 4,821,532 | A * | 4/1989 | Jaques | A44C 5/025 63/3 |
| 6,442,970 | B1 * | 9/2002 | Dangelmayer | A44C 5/08 63/38 |
| 2009/0238045 | A1 * | 9/2009 | Felton | A44C 5/24 368/282 |
| 2022/0053895 | A1 * | 2/2022 | Celant | A44C 5/24 |

OTHER PUBLICATIONS

European Search Report and Written Opinion dated Jan. 20, 2021 in priority application No. EP20191466.0; with English machine translation (total 15 pages).

* cited by examiner

TIMEPIECE COMPONENT PROVIDED WITH A CAP

This application claims priority of European patent application No. EP20191466.0 filed Aug. 18, 2020, the content of which is hereby incorporated by reference herein in its entirety.

The present invention relates to a timepiece component provided with at least one cap. The invention also relates to a timepiece comprising such a timepiece component. The invention also relates to a method for manufacturing such a timepiece component.

BACKGROUND ART

In order to improve scratch resistance, and/or change the appearance of a timepiece component, in particular of an external timepiece component such as a bracelet clasp, a bracelet link or a middle, it is known to fasten a cap to a vulnerable and/or visible part of said timepiece component. An ideal cap of this kind should meet the following requirements:

- it should permit assembly, with a timepiece component, that is simple and free from any risk of damage;
- it should be robust in order to withstand external loads such as impacts and scratches;
- it should be fastened in a reliable manner so as to avoid unintended disassembly;
- it should have an appealing esthetic appearance.

Depending on the nature, in particular of the material of the cap and of the component, the existing solutions such as brazing do not satisfactorily meet all of these requirements. Hence, the invention has the general object of proposing a novel solution for a timepiece component provided with a cap, which improves on the existing solutions, by best meeting the above requirements.

More specifically, the invention has the object of proposing a solution for a timepiece component provided with a cap that is robust, reliable, simple to implement, and that can have an appealing esthetic appearance.

SUMMARY OF THE INVENTION

To that end, the invention relates to a timepiece component, wherein it has a first part and a removable cap, the timepiece component being able to adopt a fastening configuration in which the removable cap is fastened to the first part, and a free configuration in which the cap is separated from the first part, the first part comprising at least two latching members (or hooking members) that are intended to cooperate with respectively at least two corresponding assembly members of the cap in the fastening configuration, and wherein the cap and/or the first part is elastically deformable from a rest position to a deformed position in such a way that the deformed position of the cap is suitable for positioning and removing the cap from the first part for passing from the fastening configuration to the free configuration of the timepiece component and vice versa, and such that the rest position makes it possible to stably maintain the fastening configuration of the timepiece component in which the at least two assembly members of the cap are in engagement with the at least two latching members of the first part.

The invention is specifically defined by the claims.

BRIEF DESCRIPTION OF THE DRAWINGS

These objects, features and advantages of the present invention will be disclosed in detail in the following nonlimiting description of a particular embodiment given with reference to the appended figures, in which.

DETAILED DESCRIPTION OF PARTICULAR EMBODIMENTS

The invention will be described in the context of a clasp cover. However, it may be integrated in an alternative manner in any other timepiece component, in particular a trim component such as a middle, a bracelet link, etc.

To simplify the description of the embodiment, the present document will use, by convention, the terms "longitudinal direction" for the direction along the length of a clasp or a bracelet strand, and "transverse direction" for the direction perpendicular to the length of a clasp or a bracelet strand, in the plane of a clasp (more specifically the plane of a blade or of a cover of the clasp), considering in particular the closed configuration of the clasp. The vertical direction is the direction perpendicular to the two first directions, oriented perpendicular to the plane of the clasp (more specifically of a blade or of a cover of the clasp). The adjectives "upper" and "lower" will be used in relation to this vertical direction. By extension, these directions and definitions will apply to a clasp cover, considering the position that this would have within a clasp.

Furthermore, in order to aid comprehension, the same reference signs will be used for the various variant embodiments to denote identical or similar elements.

Figure 1:
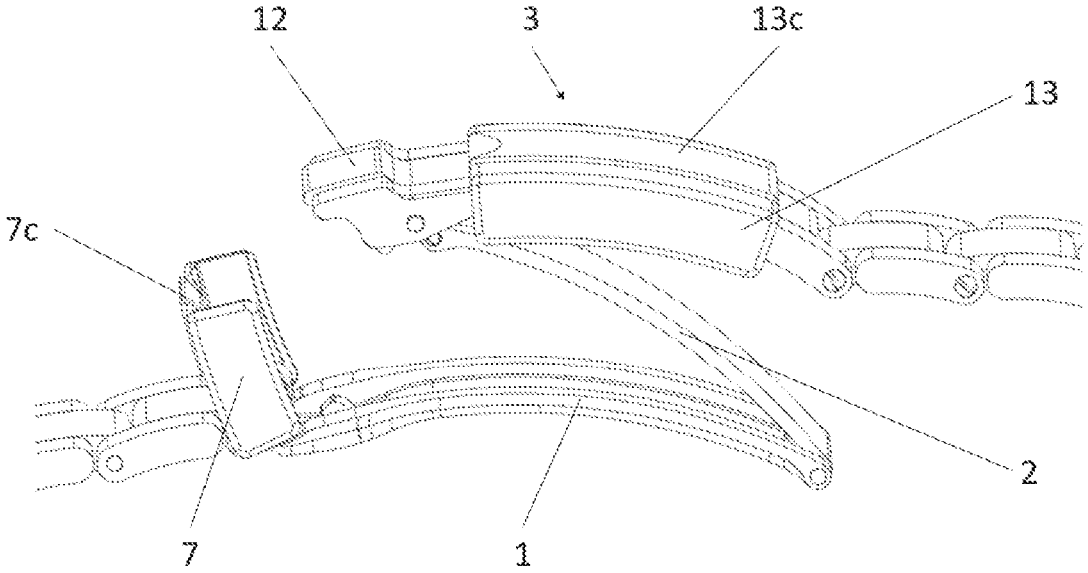
FIG. 1 depicts a perspective view of an open clasp comprising a cover provided with a cap according to one embodiment of the invention.

FIG. 1 depicts a clasp for a bracelet according to one embodiment of the invention. This clasp comprises two blades 1, 2 that are articulated about a pin at one of their ends. The free end of the blade 1 is as one with a first articulation pin that serves for articulating a complementary cover 7, 7*c*, and with a second articulation pin that serves for articulating an end of one of the strands of the bracelet. The free end of the blade 2 is as one with a movable structure 3 that is articulated so as to be able to move in rotation. Thus, the clasp can adopt an open position, as shown in FIG. 1, where it is partially deployed, and a closed position in which the second blade 2 and the structure 3 are folded and locked onto the first blade 1. The end of a first bracelet strand is fastened to the second end of the first blade 1 and the end of a second bracelet strand is fastened to the free end of the movable structure 3.

The invention relates more specifically to a clasp cover. This cover is principally integrated into the structure 3 of the clasp. The cover comprises a first part 13 which has a vertical cross section in the shape of an inverted U, having an upper face that is visible to the user, and two lateral walls that are substantially perpendicular to the upper face and are intended to laterally cover all of the clasp and its mechanism so as to hide it when in the closed position and ensure the esthetic appearance of the solution. The cover further comprises a removable cap 13*c* (or overlay). Thus, the cap is able to adopt a fastening configuration in which the removable cap 13*c* is fastened to the first part 13, and a free configuration in which the cap 13*c* is separated from the first part 13.

In addition, the clasp comprises a complementary cover 7, 7*c* that is arranged on the first blade 1 and is intended to fold down into a position of closing the clasp, to be positioned in continuity with the cover 13 arranged on the movable structure 3, and to cover a locking lever 12, and to form a single cover for the clasp that includes a safety element. This complementary cover part has a structure similar to that described hereinabove, that is to say a first part 7 that cooperates with a removable cap 7*c*. It can be assembled according to the same concept of the invention, or differently. It will not be described in greater detail hereinbelow.

The upper surface of the first part 13 of the cover has a planar orthogonal projection that is essentially rectangular in shape. The cap 13*c* takes the form of an element that is substantially planar and elongate which extends over the entire length of the upper surface of the cover and over a portion of the width of the upper surface of the cover, for example between 20% and 100%, or even between 30% and 90%, or even between 45% and 55%. It may or may not be positioned centrally on the cover. In the fastening configuration, the cap 13*c* is arranged in a portion that is set back from the first part 13, in the thickness of the upper surface of the first part of the cover, in such a way that it covers this second, set-back portion and occupies the volume freed up by this set-back portion. For example, the upper surface of the cap is continuous with the upper surface of the first part, forming an upper surface of the cover that is continuous overall. Alternatively, the upper surface of the cap is set back from or protrudes from the upper surface of the first part.

Figure 2:
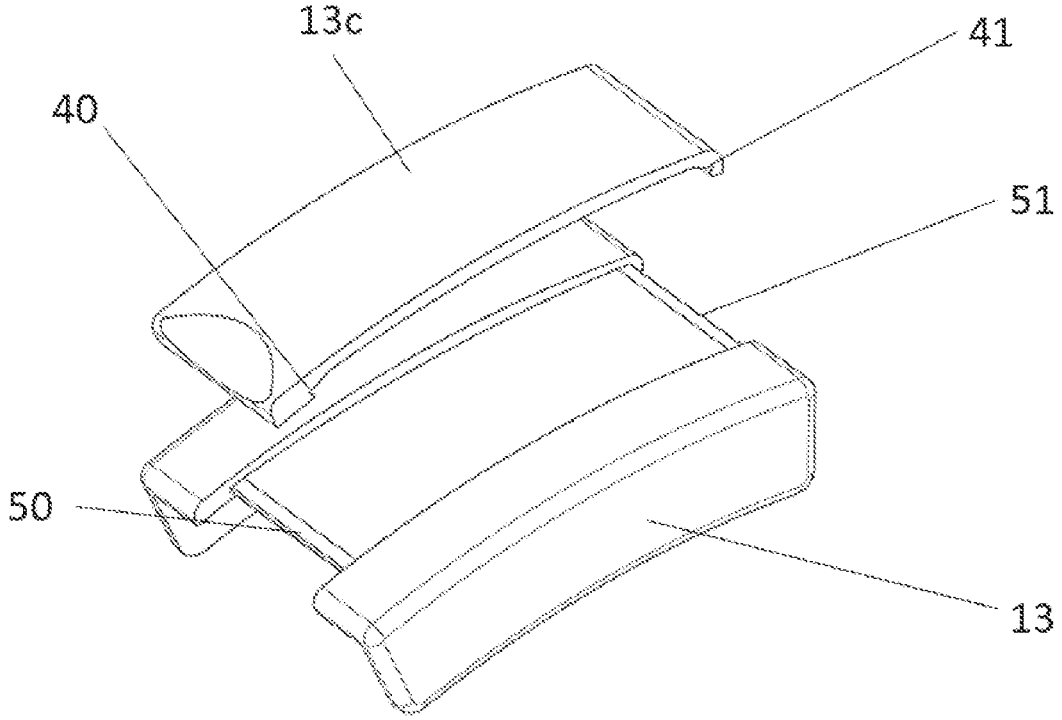
FIG. 2 depicts an exploded perspective view from above of the cover of the clasp according to a first variant of the embodiment of the invention.
Figure 3:
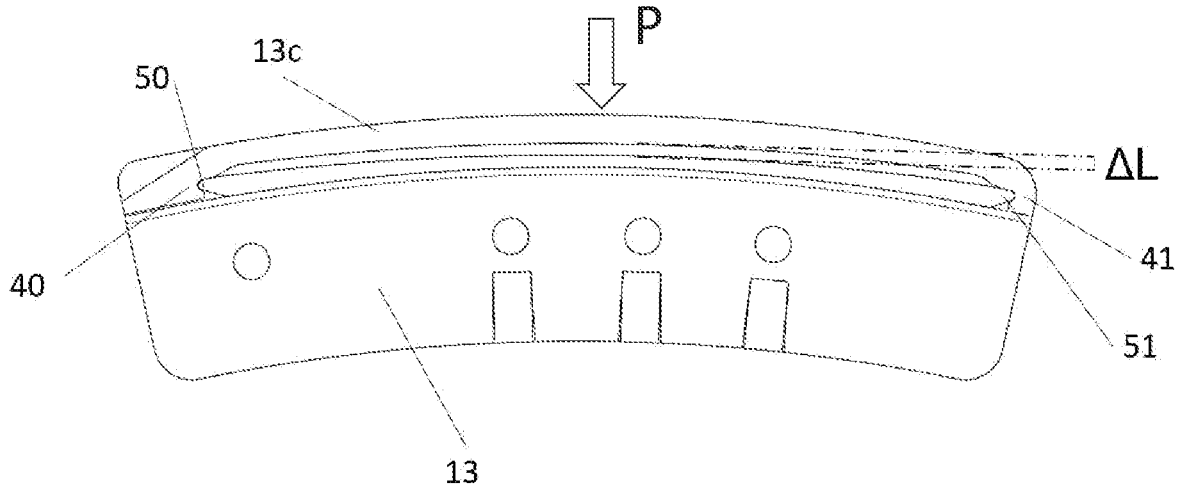
FIG. 3 depicts a view in section along a median vertical longitudinal plane of the cover of the clasp comprising a cap in the fastening configuration according to the first variant of the embodiment of the invention.

FIGS. 2 and 3 represent a first variant of the cover according to the embodiment. These figures make it possible to visualize the device for fastening the cap 13*c* on the first part 13 of the cover. The cap 13*c* comprises at least a first assembly member 40 and a second assembly member 41, which are arranged respectively at the two opposite distal ends, on that side of the cap 13*c* that is intended to be oriented towards the first part 13 of the cover, termed the lower surface according to the chosen convention. In addition, the first part 13 of the cover comprises at least a first latching member 50 and a second latching member 51. In the fastening configuration, depicted in FIG. 3, the first assembly member 40 of the cap 13*c* cooperates with the first latching member 50 of the first part 13 and the second assembly member 41 of the cap 13*c* cooperates with the second latching member 51 of the first part 13. Thus, in the fastening configuration of the cover, the latching members 50, 51 of the first part 13 and the assembly members 40, 41 of the cap 13*c* are in engagement. This latching arrangement is designed to guarantee that, in its rest position, the cap 13*c* is reliably held on the first part 13 of the cover.

According to the invention, the cap 13*c* is elastically deformable from a rest position to a deformed position in such a way that the deformed position of the cap 13*c* is suitable for positioning and removing it from the first part 13 for passing from the fastening configuration to the free configuration of the cover and vice versa, and such that its rest position makes it possible to stably maintain the fastening configuration of the cover.

As is shown in FIG. 3, in the fastening configuration of the cover, the cap 13*c* is separated from the first part 13 by a cavity which allows the cap 13*c* to deform from its rest position to its deformed position by simple pressure on the upper surface of the cap 13*c*, in the vertical direction illustrated by the arrow P. By means of this pressure, the cap 13*c* deforms and reduces all or part of the volume of the cavity. The two ends of the cap 13*c* are thus spaced apart from one another by a distance $\Delta d$.

The cavity therefore frees up a space of height $\Delta L$ between the upper surface of the first part 13 and the lower facing surface of the cap 13*c*, this height being considered along the vertical axis z. This cavity has a volume such that the first part 13 forms a stop that limits the maximum deformation of the cap 13*c* below its elastic limit when it is deformed until it comes into contact with the first part 13 by the above-mentioned pressure. The height $\Delta L$ of the cavity thus represents a deformation and mounting travel of the cap 13*c*.

The cap 13*c* is such that its mechanical deformation properties allow it to be elongated in its deformed position by modifying its natural curvature in the rest position, which allows its assembly members 40, 41 to move apart by a distance $\Delta d$ and to disengage from the latching members 50, 51. The cap 13*c* can therefore be removed from the first part 13 of the cover. It should be noted that, according to the embodiment, the cap 13*c* is therefore curved with a rest radius of curvature when in the rest position, and is curved with an increased radius of curvature when in the deformed position.

It should be noted that the mechanical deformation properties of the cap 13*c* are defined by multiple parameters, in particular its geometry and more particularly its thickness, and the material from which it is made. These parameters are chosen to achieve a compromise in defining the pressure force. Advantageously, this force is intended to deform the cap 13*c* up to its deformed position, but without being excessive, in order that said cap can be released without difficulty, in particular manually and without the use of tools. At the same time, this force is sufficiently great to avoid accidental release.

By way of example, for a cap 13*c* having, according to the geometry depicted in FIGS. 2 and 3, a length of 21 mm and a thickness of 0.7 mm in the central zone of the cap, made of raw sintered yttria-stabilized zirconia, assembled with a mounting travel $\Delta L$ of 0.24 mm, the elongation achieved by application of a force is 0.13 mm, allowing the interior of the cap 13*c* to be brought into contact with the upper surface of the first part 13.

Advantageously, the cap 13*c* takes the form of a one-piece element. It can for example be made of metal or of a material which has impact- and scratch-resistant mechanical properties, and/or which can be esthetically very appealing, for example a ceramic, cermet, glass, sapphire, mother-of-pearl, amber or natural or reconstituted stone.

Preferably, the first part 13 of the cover is made of a metal alloy, for example stainless steel, gold, platinum, bronze or titanium.

In this embodiment, the two assembly members 40, 41 of the cap have a hook-shaped section forming notches that cooperate with complementary shapes of the latching members 50, 51 (or hooking members) of the first part 13.

Optionally, at ambient temperature, the deformed position of the cap 13*c* does not make it possible to release the cap 13*c* from the first part 13 of the cover, the elongation Δd being insufficient. More specifically, release by simple unclipping of the cap 13*c* is not possible. Modification of the temperature of the cap 13*c* and/or of the first part 13 makes it possible to obtain an additional relative separation Δdt between the assembly elements by virtue of thermal expansion/contraction. At this assembly temperature, which is different from ambient temperature, the deformed position of the cap 13*c*, under the combined effect of the applied pressure and the thermal expansion of the cap 13*c*, gives rise to a total deformation Δd+Δdt which therefore makes it possible to separate the cap 13*c* and the first part 13 of the timepiece component, according to the principle described above in the context of the first variant embodiment.

Indeed, by raising or lowering the temperature of the cap 13*c* and/or of the first part 13 to a predefined assembly temperature value, the thermal expansion contribution makes it possible to modify the connection between the cap 13*c* and the first part 13 in such a way that the deformed position of the cap 13*c* allows it to be released, whereas it does not allow it to be released at ambient temperature. Thus, the applied thermal expansion makes it possible to increase the range of movement between the cap and the first part of the cover. This embodiment therefore provides additional security compared to the first variant embodiment, avoiding accidental release of the cap at ambient temperature. In addition, at the assembly temperature, the rest position of the cap 13*c* does not allow the latter to be released. Thus, the assembly and release of the cap 13*c* requires the combined action of the thermal expansion and the mechanical deformation.

Advantageously, the assembly temperature of the cap 13*c* and/or of the first part 13 is such that it requires a temperature difference, between the cap 13*c* and the first part 13, of greater than or equal to 80 degrees C., or even greater than or equal to 100 degrees C., or even greater than or equal to 200 degrees C., or even greater than or equal to 300 degrees C., or even greater than or equal to 400 degrees C., or even greater than or equal to 500 degrees C.

Advantageously, the material of the cap or of the first part that is acted upon is that with the higher coefficient of expansion, it being heated or cooled depending on its position in the assembly. The temperatures and/or temperature gradients are selected so as to obtain sufficient expansion or contraction, without fundamentally modifying the structure of the material that is acted upon, and any thermal shocks are controlled.

For example, in the case of a ceramic cap that is joined to a steel cover, the invention proposes carrying out the assembly process by preheating the cap to a predetermined assembly temperature. The expansion of the material, obtained by this heating, allows the cap to come to easily nest on the first part of the cover.

The assembled elements are dimensioned so as to take into account the elongation obtained by elastic deformation, the elongation or shortening obtained by thermal expansion/contraction, and the tolerances of the dimensions for machining and/or sintering and/or grinding of the cap. Indeed, the obtained total elongation is the sum of the elongation obtained by elastic deformation Δd and the elongation obtained by thermal deformation Δdt, and it is designed to be greater than the sum of the tolerances of the assembly dimensions between the cap and the first part of the cover.

By way of example, for a cap 13*c* having, according to the geometry depicted in FIGS. 2 and 3, a length of 21 mm and a thickness of 1 mm, made of raw sintered yttria-stabilized zirconia, assembled with a mounting travel ΔL of 0.24 mm, the elongation achieved by application of a force is 0.13 mm, allowing the interior of the cap 13*c* to be brought into contact with the upper surface of the first part 13, as previously mentioned. Heating the cap to 500° C. produces an additional elongation of 0.11 mm, and hence a total elongation of 0.24 mm.

It is therefore clear that the use of thermal expansion makes it possible to dimension the corresponding assembly and latching members in such a way as to allow assembly by heating the cap while preventing disassembly at ambient temperature.

It is thus possible to implement various embodiments within the context of this second variant of the embodiment.

Figure 4:
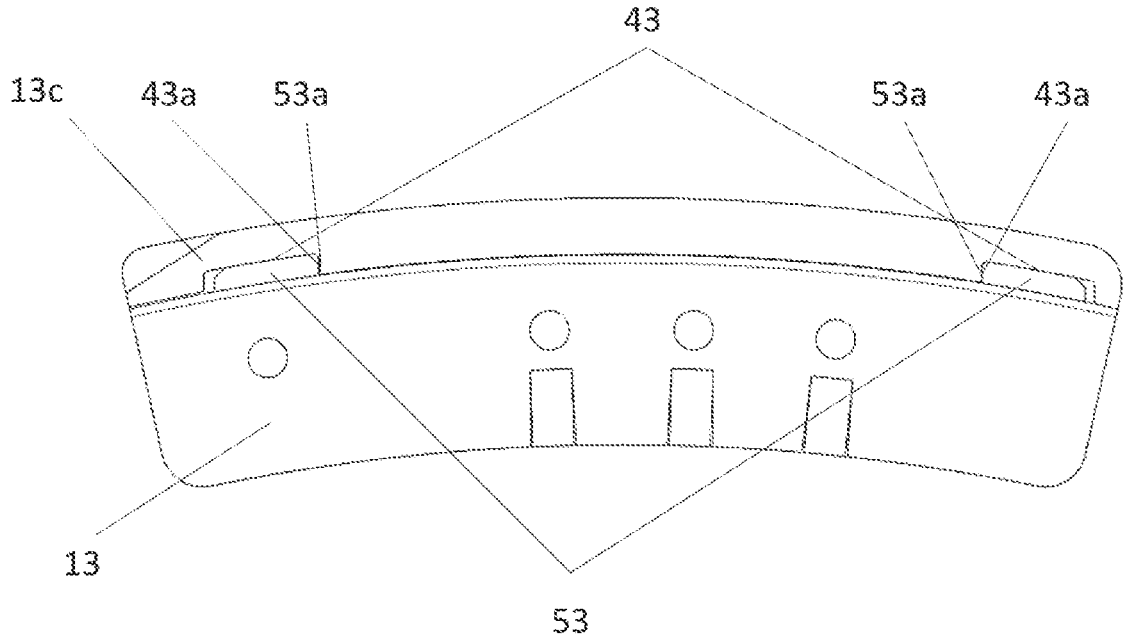
FIG. 4 depicts a view in section along a median vertical longitudinal plane of the cover of the clasp comprising a cap in the fastening configuration according to a first example of a second variant of the embodiment of the invention.
Figure 5:
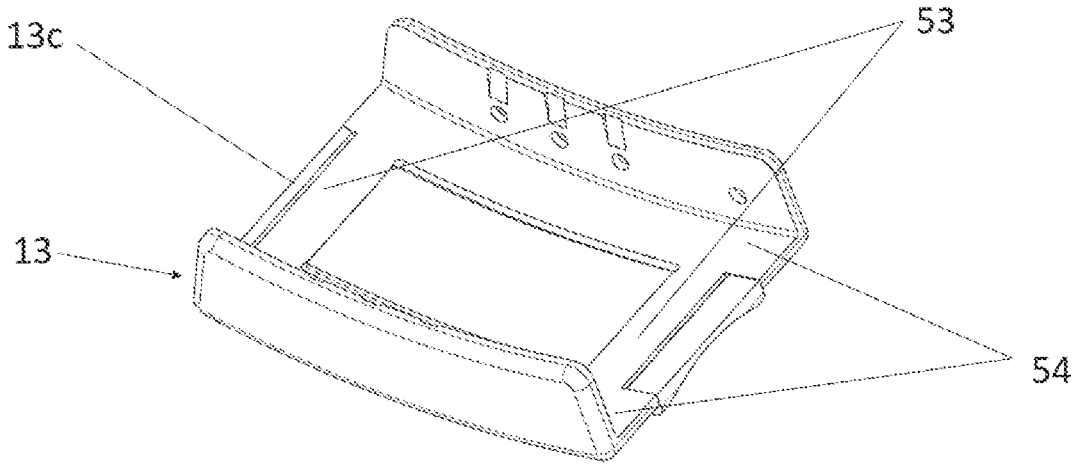
FIG. 5 depicts a perspective view from below of the cover of the clasp comprising a cap in the fastening configuration according to the first example of the second variant of the embodiment of the invention.

FIGS. 4 and 5 therefore depict, according to a first example of the second variant embodiment, a cap 13*c* that is joined to a first part 13 by means of latching and assembly members with a geometry that is different from the embodiment of FIGS. 2 and 3. The first part 13 comprises an upper surface that has a hollowed-out central part between two lateral surfaces 54 extending longitudinally. These two lateral surfaces 54 are connected to one another by two transverse beams 53 arranged close to the two longitudinal ends of the first part 13. The two lateral surfaces extend slightly beyond these transverse beams 53 at the ends of the first part 13, forming side rails 54.

The cap 13*c* comprises two transverse cutouts 43 at its lower surface, these being designed to cooperate with the two transverse beams 53 of the first part 13.

In this exemplary embodiment, the first part 13 is made of 904L stainless steel, with an initial length of 21 mm, with a distance between the transverse beams 53 of 16 mm, at ambient temperature. It is heated to the assembly temperature of 400° C., which makes it possible to obtain an additional elongation between the transverse beams 53 of 0.11 mm. The cap 13*c* is held at ambient temperature.

During an assembly phase, the cap 13*c* is thus positioned on the preheated first part 13, then elastically deformed as previously mentioned, such that it can be clipped onto the first part, by cooperation of its assembly members that consist of the two transverse cutouts 43 on the corresponding latching members of the first part that consist of the two transverse beams 53. When the cap and the first part return to their initial position, once the cap has been released and returns to its rest position and the assembly has called to ambient temperature, the flanks 43*a* of the transverse cutouts 43 of the cap 13*c* come to press against the flanks 53*a* of the transverse beams 53 of the first part 13, ensuring that the cap 13*c* is held on the first part 13.

When the first part 13 is again heated to the assembly temperature, the transverse beams 53 move away from one another owing to the expansion of the first part 13, so as to allow the cap 13*c* to be removed in its deformed position by applying pressure at the center of the cap. Preferably, the cap is kept at ambient temperature or cooled.

In a variant which is not shown, the plate is ground and a retaining undercut is arranged on the first part 13 and/or on the cap 13*c*. For example, the flanks 43*a* of the transverse cutouts 43 and/or the flanks 53*a* of the transverse beams 53 comprise snap-fitting means for snap-fitting the rims of the cap 13*c* to the first part 13. These snap-fitting means may for example take the form of a dovetail, or of a tongue-and-groove, or of one or more lug(s) with corresponding cutouts, etc. In another variant which is not illustrated, the cap 13*c* further comprises a lateral groove that is also designed to snap-fit the rims of the cap 13*c* to the first part 13.

Figure 6:
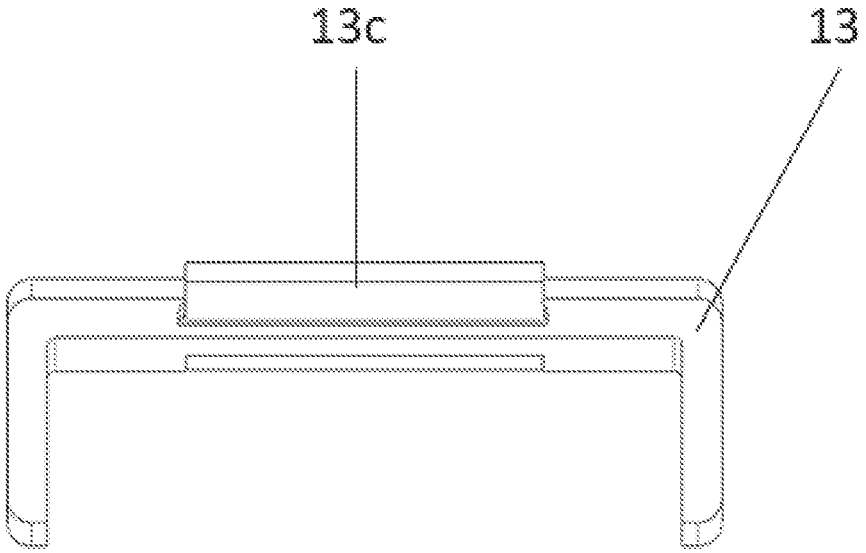
FIG. 6 depicts a transverse view of the cover of the clasp comprising a cap in the fastening configuration according to a second example of the second variant of the embodiment of the invention.
Figure 7:
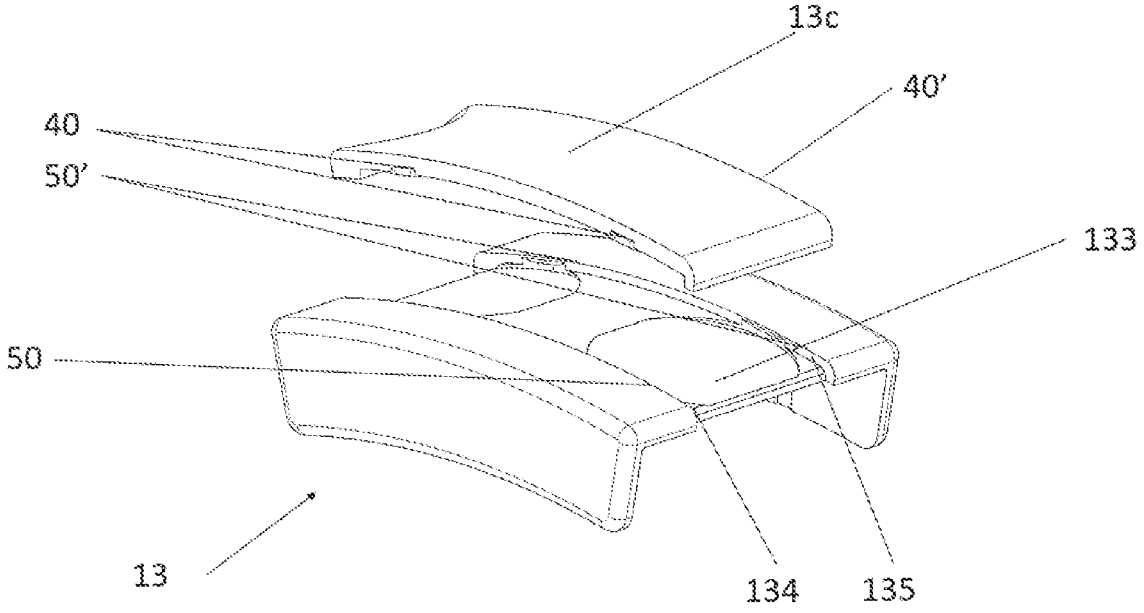
FIG. 7 depicts an exploded perspective view from above of the cover of the clasp according to the second example of the second variant of the embodiment of the invention.

FIGS. 6 and 7 depict a second exemplary embodiment according to the second variant embodiment, in which a cap 13*c* is joined to a first part 13 by means of latching and assembly members with a geometry that is different from the earlier embodiments. The first part 13 comprises an upper surface comprising a set-back central portion forming a recess for a cap 13*c*, in a manner that is similar to the embodiment shown in FIG. 1. However, the assembly and latching members are arranged transversely instead of longitudinally.

In this example, latching members 50, 50' are arranged in the lateral vertical flanks 134, 135 bounding the set-back central portion of the first part 13, in the form of snap-fitting elements. In addition, the cap 13*c* comprises corresponding assembly members that are arranged in the form of snap-fitting elements 40, 40' arranged on its lateral flank.

Advantageously, four, six or more corresponding snap-fitting elements are provided in this variant. The snap-fitting elements may for example take the form of lugs that are associated with a cutout or a groove. They are dimensioned according to the material of which they are made in order to withstand the loads experienced by the clasp.

For example, the first part 13 may be made of 21 mm 904L stainless steel, be heated to an assembly temperature of 400° C., which produces a lateral expansion of 0.06 mm. The first part 13 is deformed elastically in order to spread apart the first and second walls and allow the cap 13*c* to be positioned, so as to line up the latching members 50, 50' of the first part with the assembly members 40, 40' of the cap. The assembly is then cooled. At ambient temperature, the latching members 50, 50' of the first part and the assembly members 40, 40' of the cap are imbricated, ensuring that the cap 13*c* is held on the cover, even in the event of deformation. The cap 13*c* can be removed by re-heating specifically the first part 13 to the assembly temperature. This example illustrates that the invention can be implemented on the basis of an elastically deformable second part, instead of the cap in the other embodiments that are described.

Naturally, in one variant of this embodiment, the cap 13*c* could further comprise two rims at its longitudinal distal ends, these being arranged to cover the distal ends of the upper surface of the first part 13. Advantageously, these rims could be held on the cover by clipping, as previously described in the context of the first embodiment. More generally, the earlier variant embodiments may of course be combined.

For example, in the case of a ceramic cap that is joined to a steel cover, the invention proposes carrying out the assembly process by preheating the cap to a predetermined assembly temperature. The expansion of the material, obtained by this heating, allows the cap to come to easily nest on the metallic first part of the cover. Alternatively, the metallic first part of the cover may be heated and the ceramic cap held at ambient temperature. Finally, the concept may be implemented using any cap and first part having different thermal expansion behaviors.

Naturally, the invention is not limited to the exemplary embodiments and embodiment variants described. In particular, it is possible to have any other number of latching members on the first part and assembly members on the cap. These members may moreover be in another form, and at a different position. For example, these members may take the form of a hook and/or a notch and/or a cutaway and/or a groove and/or a lug and/or a beam. Similarly, the cap could adopt any other shape, and any other position on the first part, not necessarily centered. It may adopt a different geometry, allowing it to deform under pressure in a direction other than the vertical direction described. As a variant, as mentioned above, the geometry of the first part may be such that it allows its elastic deformation. Thus, the invention is applicable to any embodiment that involves elastic deformation of the cap and/or of the first part.

Furthermore, the invention has been described in the context of a clasp cover. However, as previously mentioned, the same concept may be integrated onto any other timepiece trim component, such as a middle or a bracelet link.

The invention also relates to a bracelet, wherein it comprises a clasp cover as previously described, or a clasp as previously described. The invention also relates to a wristwatch comprising such a bracelet, or more generally at least one timepiece component as previously described.

Finally, the invention indeed achieves the desired objectives, and has the following advantages:

- it permits assembly, of a cap on a timepiece component, that is simple and free from any risk of damage;
- it is compatible with the use of a robust cap that is able to withstand external loads such as impacts and scratches;
- it permits reliable fastening of the cap, avoiding unintended disassembly;
- the cap is removable, without any risk of damage to the timepiece component, meaning that the cap can be changed if necessary;
- the solution is compatible with the use of a multitude of materials, including those commonly used to achieve an appealing esthetic appearance.

The invention also relates to a method for manufacturing a timepiece component, wherein it comprises a step of fastening a cap 13*c* to a first part 13 of the timepiece component, deforming the cap 13*c* elastically from a rest position to a deformed position and/or elastically deforming the first part 13 from a rest position to a deformed position.

This method may involve a prior step of heating and/or cooling at least the cap 13*c*, and/or the first part 13, to an assembly temperature.

The step of fastening the cap 13*c* to the first part 13 may comprise a sub-step of positioning the cap 13*c* on the first part 13 then a sub-step of applying a vertical force substantially at the center of the cap 13*c* so as to deform it from a rest position to a deformed position in which assembly members of the cap 13*c* are able to cooperate with latching members of the first part 13.

The invention claimed is:

1. A timepiece component, comprising:

a first part, and a removable cap, the timepiece component being able to adopt a fastening configuration in which the removable cap is fastened to the first part, and a free configuration in which the cap is separated from the first part, the first part comprising at least two latching members that are intended to cooperate with respectively at least two corresponding assembly members of the cap in the fastening configuration, wherein the cap, the first part, or both the cap and the first part is or are elastically deformable from a rest position to a deformed position, so that the deformed position of the cap, of the first part, or of both the cap and the first part is suitable for positioning and removing respectively the cap from the first part, the first part from the cap, or both the cap and the first part from one another, for passing from the fastening configuration to the free configuration of the timepiece component and vice versa, and so that the rest position makes it possible to stably maintain the fastening configuration of the timepiece component in which the at least two assembly members of the cap are in engagement with the at least two latching members of the first part, wherein the timepiece component is designed so that, in the fastening configuration and at ambient temperature, the deformed position of the cap, of the first part, or of both the cap and the first part does not allow the cap to be released from the first part of the timepiece component, and so that, in the fastening configuration, the deformed position of the cap, of the first part, or the both the cap and the first part allows the cap to be released from the first part of the timepiece component by raising or lowering the temperature of the cap, of the first part, or of both the cap and the first part to an assembly temperature value, making it possible to pass from the fastening configuration to the free configuration of the timepiece component by thermal expansion contribution, wherein the assembly temperature of the cap, of the first part, or of both the cap and the first part is so that the assembly temperature requires a temperature difference, between the cap and the first part, of greater than or equal to 80 degrees C.

2. The timepiece component as claimed in claim 1, wherein the application of an assembly temperature to the cap, to the first part, or to both the cap and the first part makes it possible to assemble the cap in the deformed position with the first part, making it possible to pass from the free configuration to the fastening configuration of the timepiece component, and makes it possible to stably maintain the fastening configuration of the timepiece component in which the cap is as one with the first part when the cap, the first part, or both the cap and the first part is or are in the rest position thereof.

3. The timepiece component as claimed in claim 1, wherein, in the fastening configuration of the timepiece component, the cap is separated from the first part by a cavity which allows the cap to deform from the rest position thereof to the deformed position thereof by simple pressure on the cap, by means of which the cap deforms so as to occupy all or part of a volume of the cavity.

4. The timepiece component as claimed in claim 3, wherein the volume of the cavity is so that the first part forms a stop that limits the maximum deformation of the cap below an elastic limit thereof.

5. The timepiece component as claimed in claim 1, wherein, in the fastening configuration of the timepiece component, the cap is separated from the first part by a cavity which allows the cap to deform from the rest position thereof to the deformed position thereof by simple pressure on the cap, by means of which the cap deforms so as to occupy all or part of a volume of the cavity, and wherein at ambient temperature the maximum deformation of the cap, of the first part, or of both the cap and the first part does not make it possible to release the cap, the first part, or both the cap and the first part by simple unclipping of the cap, of the first part, or of both the cap and the first part.

6. The timepiece component as claimed in claim 1, wherein the cap is curved with a rest radius of curvature when in the rest position, and wherein the cap is curved with an increased radius of curvature when in the deformed position.

7. The timepiece component as claimed in claim 1, wherein the cap has a form of a substantially planar and elongate element, and wherein the cap comprises at least a first assembly member and a second assembly member that are arranged respectively at two opposite distal ends of the cap, on two opposite lateral sides of the cap, or on both two opposite distal ends and two opposite lateral sides of the cap, the first and second assembly members being arranged on a surface of the cap that is intended to be oriented towards the first part of the timepiece component when in the fastening configuration, on an edge face of the cap, or on both a surface of the cap that is intended to be oriented towards the first part of the timepiece component when in the fastening configuration and an edge of the cap.

8. The timepiece component as claimed in claim 1, wherein the first part comprises at least a first latching member and a second latching member, and wherein the cap comprises at least a first assembly member and a second assembly member that are intended to cooperate respectively with the at least one first latching member and the at least one second latching member of the first part, wherein at least one selected from the group consisting of the first latching member of the first part, the second latching member of the first part, the first assembly member of the cap, and the second assembly member of the cap, has a form of at least one selected from the group consisting of a hook, a notch, a cutaway, a groove, a lug, and a beam.

9. The timepiece component as claimed in claim 1, wherein:

the timepiece component is a bracelet clasp cover and the cap is a substantially planar element that is able to extend over all or part of an upper surface of the cover in the fastening configuration of the timepiece component; or the timepiece component is a middle and the cap is a substantially planar element that is able to fasten to all or part of the upper or lateral surface of the middle; or the timepiece component is a bracelet link and the cap is a substantially planar element that is able to fasten to all or part of the upper surface of the bracelet link.

10. The timepiece component as claimed in claim 1, wherein the first part is made of a metal alloy.

11. The timepiece component as claimed in claim 10, wherein the metal alloy is selected from the group consisting of stainless steel, gold, platinum, bronze and titanium.

12. The timepiece component as claimed in claim 1, wherein the cap is made of ceramic, cermet, glass, sapphire, mother-of-pearl, amber or natural or reconstituted stone.

13. A timepiece, comprising a timepiece component as claimed in claim 1.

14. A method for manufacturing a timepiece component as claimed in claim 1, the method comprising:

fastening the cap to the first part of the timepiece component, deforming the cap, the first part, or both the cap and the first part elastically from the rest position to the deformed position thereof.

15. The method for manufacturing a timepiece component as claimed in claim 14, wherein the method comprises, before the fastening and the deforming:

heating, cooling, or both heating and cooling the cap, the first part, or both the cap and the first to an assembly temperature.

16. The method for manufacturing a timepiece component as claimed in claim 14, wherein the fastening of the cap to the first part comprises:

positioning the cap on the first part, then applying a vertical force substantially at a center of the cap so as to deform the cap from the rest position thereof to the deformed position thereof in which assembly members of the cap are able to cooperate with the latching members of the first part.

17. The timepiece component as claimed in claim 1, wherein the assembly temperature of the cap, of the first part, or of both the cap and the first part is so that the assembly temperature requires a temperature difference, between the cap and the first part, of greater than or equal to 300 degrees C.

18. The timepiece component as claimed in claim 1, wherein the assembly temperature of the cap, of the first part, or of both the cap and the first part is so that the assembly temperature requires a temperature difference, between the cap and the first part, of greater than or equal to 500 degrees C.

19. The timepiece component as claimed in claim 1, wherein the assembly temperature of the cap, of the first part, or of both the cap and the first part is so that the assembly temperature requires a temperature difference, between the cap and the first part, of greater than or equal to 200 degrees C.

20. The timepiece component as claimed in claim 1, wherein the assembly temperature of the cap, of the first part, or of both the cap and the first part is so that the assembly temperature requires a temperature difference, between the cap and the first part, of greater than or equal to 400 degrees C.

* * * * *